US011259374B2

(12) United States Patent
Hsia

(10) Patent No.: US 11,259,374 B2
(45) Date of Patent: Feb. 22, 2022

(54) SOLID-STATE LIGHTING WITH COMMANDS AND CONTROLS

(71) Applicant: Aleddra Inc., Renton, WA (US)

(72) Inventor: Chungho Hsia, Bellevue, WA (US)

(73) Assignee: Aleddra Inc., Renton, WA (US)

( * ) Notice: Subject to any disclaimer, the term of this patent is extended or adjusted under 35 U.S.C. 154(b) by 29 days.

(21) Appl. No.: 17/016,296

(22) Filed: Sep. 9, 2020

(65) Prior Publication Data

US 2020/0413503 A1 Dec. 31, 2020

Related U.S. Application Data

(63) Continuation-in-part of application No. 16/989,016, filed on Aug. 10, 2020, now Pat. No. 11,122,658, which is a continuation-in-part of application No. 16/929,540, filed on Jul. 15, 2020, now Pat. No. 11,116,057, which is a continuation-in-part of application No. 16/904,206, filed on Jun. 17, 2020, now Pat. No. 11,102,864, which is a continuation-in-part of application No. 16/880,375, filed on May 21, 2020, which is a continuation-in-part of application No. 16/861,137, filed on Apr. 28, 2020, now Pat. No. 10,992,161, which is a continuation-in-part of application No. 16/830,198, filed on Mar. 25, 2020, now Pat. No. 10,869,373, (Continued)

(51) Int. Cl.

| | |
|---|---|
| ***H05B 39/00*** | (2006.01) |
| ***H05B 45/14*** | (2020.01) |
| ***H05B 47/185*** | (2020.01) |
| ***H05B 45/31*** | (2020.01) |
| ***H05B 45/325*** | (2020.01) |

(52) U.S. Cl.

CPC ..... *H05B 45/14* (2020.01); *H05B 45/31* (2020.01); *H05B 45/325* (2020.01); *H05B 47/185* (2020.01)

(58) Field of Classification Search

CPC .. H02J 2207/20; H02J 7/04; H02J 7/00; H02J 7/0031; H02J 7/0048; H02J 7/0068; H02J 7/00714; H02J 9/065; H02J 7/06; H05B 45/37; H05B 45/382; H05B 45/30; H05B 45/31; H05B 45/325; Y02B 20/30; F21S 9/022; F21Y 2115/10

See application file for complete search history.

(56) References Cited

U.S. PATENT DOCUMENTS 8,773,030 B2 * 7/2014 Woytowitz ..... H05B 47/185 315/210

8,823,272 B2 * 9/2014 Trainor ..... H05B 45/10 315/200 R

* cited by examiner

*Primary Examiner* — Omar Rojas Cadima

(74) *Attorney, Agent, or Firm* — Han IP PLLC; Andy M. Han

(57) ABSTRACT

A light-emitting diode (LED) luminaire controller comprising a transceiver circuit, a power converter circuit, and a control circuit is adopted to convert remote control signals into a pulse-width modulation (PWM) signal and a controllable DC voltage to operate an external LED luminaire by turning it on and off and controlling its luminous intensity. The LED luminaire controller further comprises a remote controller. When the remote control signals are initiated by the remote controller with phase-shift keying (PSK) signals transmitted, the transceiver circuit can demodulate such PSK signals and subsequently send the PWM signal, the controllable DC voltage, and a metering command to the control circuit to request responses accordingly.

15 Claims, 3 Drawing Sheets

Related U.S. Application Data which is a continuation-in-part of application No. 16/735,410, filed on Jan. 6, 2020, now Pat. No. 10,660,179, which is a continuation-in-part of application No. 16/694,970, filed on Nov. 25, 2019, now Pat. No. 10,602,597, which is a continuation-in-part of application No. 16/681,740, filed on Nov. 12, 2019, now Pat. No. 10,959,310, which is a continuation-in-part of application No. 16/664,034, filed on Oct. 25, 2019, now Pat. No. 10,660,184, which is a continuation-in-part of application No. 16/572,040, filed on Sep. 16, 2019, now Pat. No. 10,645,782, which is a continuation-in-part of application No. 16/547,502, filed on Aug. 21, 2019, now Pat. No. 10,485,073, which is a continuation-in-part of application No. 16/530,747, filed on Aug. 2, 2019, now Pat. No. 10,492,265, which is a continuation-in-part of application No. 16/458,823, filed on Jul. 1, 2019, now Pat. No. 10,485,065, which is a continuation-in-part of application No. 16/432,735, filed on Jun. 5, 2019, now Pat. No. 10,390,396, which is a continuation-in-part of application No. 16/401,849, filed on May 2, 2019, now Pat. No. 10,390,395, which is a continuation-in-part of application No. 16/296,864, filed on Mar. 8, 2019, now Pat. No. 10,390,394, which is a continuation-in-part of application No. 16/269,510, filed on Feb. 6, 2019, now Pat. No. 10,314,123, which is a continuation-in-part of application No. 16/247,456, filed on Jan. 14, 2019, now Pat. No. 10,327,298, which is a continuation-in-part of application No. 16/208,510, filed on Dec. 3, 2018, now Pat. No. 10,237,946, which is a continuation-in-part of application No. 16/154,707, filed on Oct. 8, 2018, now Pat. No. 10,225,905, which is a continuation-in-part of application No. 15/947,631, filed on Apr. 6, 2018, now Pat. No. 10,123,388, which is a continuation-in-part of application No. 15/911,086, filed on Mar. 3, 2018, now Pat. No. 10,136,483, which is a continuation-in-part of application No. 15/897,106, filed on Feb. 14, 2018, now Pat. No. 10,161,616, which is a continuation-in-part of application No. 15/874,752, filed on Jan. 18, 2018, now Pat. No. 10,036,515, which is a continuation-in-part of application No. 15/836,170, filed on Dec. 8, 2017, now Pat. No. 10,021,753, which is a continuation-in-part of application No. 15/649,392, filed on Jul. 13, 2017, now Pat. No. 9,986,619, which is a continuation-in-part of application No. 15/444,536, filed on Feb. 28, 2017, now Pat. No. 9,826,595, which is a continuation-in-part of application No. 15/362,772, filed on Nov. 28, 2016, now Pat. No. 9,967,927, which is a continuation-in-part of application No. 15/225,748, filed on Aug. 1, 2016, now Pat. No. 9,743,484, which is a continuation-in-part of application No. 14/818,041, filed on Aug. 4, 2015, now Pat. No. 9,420,663, which is a continuation-in-part of application No. 14/688,841, filed on Apr. 16, 2015, now Pat. No. 9,288,867, which is a continuation-in-part of application No. 14/465,174, filed on Aug. 21, 2014, now Pat. No. 9,277,603, which is a continuation-in-part of application No. 14/135,116, filed on Dec. 19, 2013, now Pat. No. 9,163,818, which is a continuation-in-part of application No. 13/525,249, filed on Jun. 15, 2012, now Pat. No. 8,749,167.

SOLID-STATE LIGHTING WITH COMMANDS AND CONTROLS

CROSS-REFERENCE TO RELATED APPLICATIONS

The present disclosure is part of a continuation-in-part (CIP) application of U.S. patent application Ser. No. 16/989,016, filed 10 Aug. 2020, which is part of CIP application of U.S. patent application Ser. No. 16/929,540, filed 15 Jul. 2020, which is part of CIP application of U.S. patent application Ser. No. 16/904,206, filed 17 Jun. 2020, which is part of CIP application of U.S. patent application Ser. No. 16/880,375, filed 21 May 2020, which is part of CIP application of U.S. patent application Ser. No. 16/861,137, filed 28 Apr. 2020, which is part of CIP application of U.S. patent application Ser. No. 16/830,198, filed 25 Mar. 2020, which is part of CIP application of U.S. patent application Ser. No. 16/735,410, filed 6 Jan. 2020 and issued as U.S. Pat. No. 10,660,179 on 19 May 2020, which is part of CIP application of U.S. patent application Ser. No. 16/694,970, filed 25 Nov. 2019 and issued as U.S. Pat. No. 10,602,597 on 24 Mar. 2020, which is part of CIP application of U.S. patent application Ser. No. 16/681,740, filed 12 Nov. 2019, which is part of CIP application of U.S. patent application Ser. No. 16/664,034, filed 25 Oct. 2019 and issued as U.S. Pat. No. 10,660,184 on 19 May 2020, which is part of CIP application of U.S. patent application Ser. No. 16/572,040, filed 16 Sep. 2019 and issued as U.S. Pat. No. 10,645,782 on 5 May 2020, which is part of CIP application of U.S. patent application Ser. No. 16/547,502, filed 21 Aug. 2019 and issued as U.S. Pat. No. 10,485,073 on 19 Nov. 2019, which is part of CIP application of U.S. patent application Ser. No. 16/530,747, filed 2 Aug. 2019 and issued as U.S. Pat. No. 10,492,265 on 26 Nov. 2019, which is part of CIP application of U.S. patent application Ser. No. 16/458,823, filed 1 Jul. 2019 and issued as U.S. Pat. No. 10,485,065 on 19 Nov. 2019, which is part of CIP application of U.S. patent application Ser. No. 16/432,735, filed 5 Jun. 2019 and issued as U.S. Pat. No. 10,390,396 on 20 Aug. 2019, which is part of CIP application of U.S. patent application Ser. No. 16/401,849, filed 2 May 2019 and issued as U.S. Pat. No. 10,390,395 on 20 Aug. 2019, which is part of CIP application of U.S. patent application Ser. No. 16/296,864, filed 8 Mar. 2019 and issued as U.S. Pat. No. 10,390,394 on 20 Aug. 2019, which is part of CIP application of U.S. patent application Ser. No. 16/269,510, filed 6 Feb. 2019 and issued as U.S. Pat. No. 10,314,123 on 4 Jun. 2019, which is part of CIP application of U.S. patent application Ser. No. 16/247,456, filed 14 Jan. 2019 and issued as U.S. Pat. No. 10,327,298 on 18 Jun. 2019, which is part of CIP application of U.S. patent application Ser. No. 16/208,510, filed 3 Dec. 2018 and issued as U.S. Pat. No. 10,237,946 on 19 Mar. 2019, which is part of CIP application of U.S. patent application Ser. No. 16/154,707, filed 8 Oct. 2018 and issued as U.S. Pat. No. 10,225,905 on 5 Mar. 2019, which is part of a CIP application of U.S. patent application Ser. No. 15/947,631, filed 6 Apr. 2018 and issued as U.S. Pat. No. 10,123,388 on 6 Nov. 2018, which is part of a CIP application of U.S. patent application Ser. No. 15/911,086, filed 3 Mar. 2018 and issued as U.S. Pat. No. 10,136,483 on 20 Nov. 2018, which is part of a CIP application of U.S. patent application Ser. No. 15/897,106, filed 14 Feb. 2018 and issued as U.S. Pat. No. 10,161,616 on 25 Dec. 2018, which is a CIP application of U.S. patent application Ser. No. 15/874,752, filed 18 Jan. 2018 and issued as U.S. Pat. No. 10,036,515 on 31 Jul. 2018, which is a CIP application of U.S. patent application Ser. No. 15/836,170, filed 8 Dec. 2017 and issued as U.S. Pat. No. 10,021,753 on 10 Jul. 2018, which is a CIP application of U.S. patent application of Ser. No. 15/649,392 filed 13 Jul. 2017 and issued as U.S. Pat. No. 9,986,619 on 29 May 2018, which is a CIP application of U.S. patent application Ser. No. 15/444,536, filed 28 Feb. 2017 and issued as U.S. Pat. No. 9,826,595 on 21 Nov. 2017, which is a CIP application of U.S. patent application Ser. No. 15/362,772, filed 28 Nov. 2016 and issued as U.S. Pat. No. 9,967,927 on 8 May 2018, which is a CIP application of U.S. patent application Ser. No. 15/225,748, filed 1 Aug. 2016 and issued as U.S. Pat. No. 9,743,484 on 22 Aug. 2017, which is a CIP application of U.S. patent application Ser. No. 14/818,041, filed 4 Aug. 2015 and issued as U.S. Pat. No. 9,420,663 on 16 Aug. 2016, which is a CIP application of U.S. patent application Ser. No. 14/688,841, filed 16 Apr. 2015 and issued as U.S. Pat. No. 9,288,867 on 15 Mar. 2016, which is a CIP application of U.S. patent application Ser. No. 14/465,174, filed 21 Aug. 2014 and issued as U.S. Pat. No. 9,277,603 on 1 Mar. 2016, which is a CIP application of U.S. patent application Ser. No. 14/135,116, filed 19 Dec. 2013 and issued as U.S. Pat. No. 9,163,818 on 20 Oct. 2015, which is a CIP application of U.S. patent application Ser. No. 13/525,249, filed 15 Jun. 2012 and issued as U.S. Pat. No. 8,749,167 on 10 Jun. 2014. Contents of the above-identified applications are incorporated herein by reference in their entirety.

BACKGROUND

Technical Field

The present disclosure relates to light-emitting diode (LED) luminaire controls and more particularly to an LED luminaire controller with remote commands and controls, which can turn on and off, dim up and down, and meter an external LED luminaire coupled to the LED luminaire controller.

Description of the Related Art

Solid-state lighting from semiconductor LEDs has received much attention in general lighting applications today. Because of its potential for more energy savings, better environmental protection (with no hazardous materials used), higher efficiency, smaller size, and longer lifetime than conventional incandescent bulbs and fluorescent tubes, the LED-based solid-state lighting will be a mainstream for general lighting in the near future. Meanwhile, as LED technologies develop with the drive for energy efficiency and clean technologies worldwide, more families and organizations will adopt LED lighting for their illumination applications. In this trend, the potential safety concerns such as risk of electric shock and fire become especially important and need to be well addressed.

In today's retrofit applications of an LED lamp to replace an existing fluorescent lamp, consumers may choose either to adopt a ballast-compatible LED lamp with an existing ballast used to operate the fluorescent lamp or to employ an alternate-current (AC) mains-operable LED lamp by removing/bypassing the ballast. Either application has its advantages and disadvantages. In the former case, although the ballast consumes extra power, it is straightforward to replace the fluorescent lamp without rewiring, which consumers have a first impression that it is the best alternative. But the fact is that total cost of ownership for this approach is high regardless of very low initial cost. For example, the ballast-compatible LED lamps work only with particular types of ballasts. If the existing ballast is not compatible with the ballast-compatible LED lamp, the consumer will have to replace the ballast. Some facilities built long time ago incorporate different types of fixtures, which requires extensive labor for both identifying ballasts and replacing incompatible ones. Moreover, the ballast-compatible LED lamp can operate longer than the ballast. When an old ballast fails, a new ballast will be needed to replace in order to keep the ballast-compatible LED lamps working. Maintenance will be complicated, sometimes for the lamps and sometimes for the ballasts. The incurred cost will preponderate over the initial cost savings by changeover to the ballast-compatible LED lamps for hundreds of fixtures throughout a facility. In addition, replacing a failed ballast requires a certified electrician. The labor costs and long-term maintenance costs will be unacceptable to end users. From energy saving point of view, a ballast constantly draws power, even when the ballast-compatible LED lamps are dead or not installed. In this sense, any energy saved while using the ballast-compatible LED lamps becomes meaningless with the constant energy use by the ballast. In the long run, the ballast-compatible LED lamps are more expensive and less efficient than self-sustaining AC mains-operable LED lamps.

On the contrary, an AC mains-operable LED lamp does not require a ballast to operate. Before use of the AC mains-operable LED lamp, the ballast in a fixture must be removed or bypassed. Removing or bypassing the ballast does not require an electrician and can be replaced by end users. Each AC mains-operable LED lamp is self-sustaining. Once installed, the AC mains-operable LED lamps will only need to be replaced after 50,000 hours. In view of above advantages and disadvantages of both the ballast-compatible LED lamps and the AC mains-operable LED lamps, it seems that market needs a most cost-effective solution by using a universal LED lamp that can be used with the AC mains and is compatible with a ballast so that LED lamp users can save an initial cost by changeover to such an LED lamp followed by retrofitting the lamp fixture to be used with the AC mains when the ballast dies.

The AC mains-operable LED luminaires can easily be used with a remote lighting controller, taking advantages of no rewiring needed for remote control. No wiring or rewiring can save dramatic installation cost, and such a lighting controller is free of the wiring errors in contrast to an all wired system that is highly susceptible to such errors. With the acceleration of LED luminaire deployment in the lighting industry, the needs of energy saving, utilization efficiency of lighting energy, and intelligent control of lighting have become very urgent. Traditional wired luminaire controls have drawbacks such as only on-off for manual switch control, susceptibility of the interference by the strong magnetic field from a power line for power carrier control, and failing to meet the requirements of centralized monitoring, recording, and energy management. On the other hand, the lighting industry needs controllers that can not only turn on and off but also dim up and down a regular LED luminaire coupled to the LED luminaire controller using existing wireless technologies. It is, therefore, a motive to design such an LED luminaire controller incorporating a cost-effective remote control technology that is simple to implement without commissioning in the field and without wiring and rewiring.

SUMMARY

An LED luminaire controller is coupled to an external LED luminaire comprising external one or more LED arrays and an external power supply unit that may comprise a pair of dimming ports D+D−. The LED luminaire controller comprises a power supply unit comprising two electrical conductors "L" and "N" and a power converter circuit. The two electrical conductors "L" and "N" are configured to couple to the AC mains. The power converter circuit is configured to couple to the two electrical conductors "L" and "N" to convert a line voltage from the AC mains into a first direct-current (DC) voltage. The LED luminaire controller further comprises a control circuit comprising a relay switch. The relay switch comprises a coil with a set voltage and is configured to couple the line voltage from the AC mains to the external power supply unit to operate thereof when enabled, subsequently powering up the external one or more LED arrays coupled with the external power supply unit. The external power supply unit comprises an input operating voltage range such as 100-347 volts (AC or DC). The external power supply unit comprises two electrical conductors "Lo" and "N". The pair of dimming ports D+D− are configured to receive a 0-to-10-volt (V) voltage for luminaire dimming applications. The external power supply unit is a current source, providing various LED driving current to the external one or more LED arrays to dim up or dim down thereof according to the 0-to-10-V voltage. The first DC voltage is a low DC voltage such as 5 V, which is less than 10 V. To convert the low DC voltage into the 0-to-10-V voltage, it is necessary to boost the low DC voltage to a higher operating voltage such as 12 V to operate circuits that transform a dimming signal to the 0-to-10-V voltage. For this purpose, the control circuit further comprises a first voltage converter circuit configured to up-convert the first DC voltage into a second DC voltage. Both the first DC voltage and the second DC voltage are with respect to a same ground reference.

The LED luminaire controller further comprises a first transceiver circuit comprising a first transceiver and a decoder and controller. The first transceiver circuit is coupled to the control circuit and configured to demodulate various phase-shift keying (PSK) band-pass signals and to output a pulse-width modulation (PWM) signal and a signal voltage via the decoder and controller in response to the various PSK band-pass signals received by the first transceiver. The first transceiver requires an operating voltage such as 3.3 V to operate. To convert the first DC voltage into the 3.3 V, it is necessary to down-convert the first DC voltage. For this purpose, the control circuit further comprises a second voltage converter circuit configured to down-convert the first DC voltage into a third DC voltage. Both the first DC voltage and the third DC voltage share a same ground reference. The second voltage converter circuit may be a type of a low-dropout (LDO) regulator featuring linearity to maintain a steady voltage, free of switching noises, simplicity, small size, high efficiency, etc.

The PWM signal is the dimming signal configured to control the external power supply unit to provide the various LED driving current to dim up or dim down the external one or more LED arrays. However, the pair of dimming ports D+D− are configured to accept the 0-to-10-V voltage. For this purpose, the control circuit further comprises a PWM-to-voltage converter coupled to the first transceiver circuit and configured to convert the PWM signal into the 0-to-10-V voltage in response to one of the various PSK band-pass signals. The PWM-to-voltage converter comprises a first transistor, a low-pass filter circuit, and an optocoupler circuit coupled between the first transceiver circuit and the first transistor. The optocoupler circuit is configured to buffer the PWM signal in a way that the low-pass filter circuit powered by the second DC voltage can be operated without affecting an operation of the first transceiver circuit powered by the third DC voltage. The first transistor is configured to receive the first DC voltage and to convert the first DC voltage into a modulated voltage according to the PWM signal. The low-pass filter circuit is configured to convert the modulated voltage into the 0-to-10-V voltage to operate a dimming circuit in the external power supply unit without affecting stability of the low-pass filter circuit.

The first transceiver circuit further comprises an antenna embedded on a printed circuit board (PCB) and a radio-frequency (RF) front-end transmitter/receiver configured to provide a single-ended matched impedance between an input to the RF front-end transmitter/receiver and an output from the first transceiver for maximum transmit/receive efficiency. In other words, this important process is designed to ensure signals to transmit without signal reflections and with a required transmission power. The decoder and controller comprises a microcontroller, a microchip, or a programmable logic controller.

The relay switch further comprises an AC input electrical terminal, an output electrical terminal, and a pair of DC electrical terminals, in which the AC input electrical terminal is configured to couple to a hot wire (i.e., "Li") of the line voltage from the AC mains. The output electrical terminal is configured to relay the hot wire of the line voltage to the external LED luminaire from "Li" to "Lo". The pair of DC electrical terminals are coupled to the coil with one of the pair of DC electrical terminals coupled to the first DC voltage and the other one of the pair of DC electrical terminals coupled to a controllable DC voltage compatible to the first DC voltage. The control circuit further comprises a second transistor coupled to the first DC voltage and controlled by the signal voltage the first transceiver circuit outputs. The second transistor is configured to generate the controllable DC voltage. When the signal voltage is absent, the controllable DC voltage disables the coil and relays the hot wire of the line voltage to the external LED luminaire to operate thereof. On the other hand, when the signal voltage is present, the second transistor is on, and the controllable DC voltage is pulled down. The coil thus receives the set voltage to operate, which disconnects the hot wire of the line voltage from coupling to the external LED luminaire.

The control circuit further comprises a metering circuit coupled to the relay switch and configured to measure an operating voltage and an electric current flowing into the external LED luminaire. The metering circuit comprises a metering device that collects data of the operating voltage and the electric current and calculates power consumption of the external LED luminaire. The metering device serially transfers the data out to the first transceiver circuit via a port "T" when requested via a port "R". The metering circuit further comprises a primary wire connected between "L" and "Li", configured to couple the line voltage to the relay switch, furthering down to the external LED luminaire when the relay switch is set to relay the line voltage from "Li" to "Lo". The primary wire is configured to measure the electric current flowing through the primary wire and to the external LED luminaire.

The PWM-to-voltage converter is coupled to the first transceiver circuit via a port "P" and configured to convert the PWM signal into the 0-to-10-V voltage in response to one of the various PSK band-pass signals. The PWM-to-voltage converter further comprises a first transistor, a low-pass filter circuit, and an optocoupler circuit coupled between the transceiver circuit and the first transistor. The optocoupler circuit comprises an LED and a photo-transistor. The LED is configured to emit a light signal responsive to the PWM signal whereas the photo-transistor is configured to receive the light signal and to interface the PWM signal with the first DC voltage via the first transistor. In other words, the optocoupler circuit is configured to buffer the PWM signal in a way that the low-pass filter circuit powered by the second DC voltage can be operated without affecting an operation of the first transceiver circuit powered by the third DC voltage. The first transistor is coupled to the photo-transistor and configured to receive the first DC voltage and to convert the first DC voltage into a modulated voltage according to the PWM signal.

The low-pass filter circuit comprises a voltage follower, an operational amplifier, and at least one stage of a resistor-capacitor (RC) filter coupled to the operational amplifier as an input. The low-pass filter circuit is configured to convert the modulated voltage into the 0-to-10-V voltage whereas the voltage follower is configured to serve as a buffer to output the 0-to-10-V voltage to the external LED luminaire to operate a dimming circuit in the external power supply unit without affecting stability of the low-pass filter circuit. The low-pass filter circuit further comprises a voltage divider with two resistors connected in series. A signal feedback from the voltage divider to the other input of the operational amplifier to set up a maximum voltage of 10 V for the 0-to-10-V voltage.

The metering circuit comprises the metering device that collects data of the operating voltage and the electric current and calculates power consumption of the external LED luminaire. The metering device comprises a data register and an input/output interface. The data register is configured to store data of the operating voltage, the electric current, and a calculated power consumption of the external LED luminaire. The input/output interface serially transfers the data out via the port "T" to the first transceiver circuit when requested via the port "R". The metering circuit further comprises a voltage transformer and an AC current transducer respectively configured to measure the operating voltage and the electric current flowing into the external LED luminaire. The voltage transformer comprises a turns ratio of 1000:1000 configured to isolate an input from a measuring output and to provide an acceptable linearity for an accurate voltage measurement. The AC current transducer comprises a coil winding wound around the primary wire connected between "L" and "Li". The electric current flowing through the primary wire induces a voltage that is proportional to the rate of change of the electric current enclosed by the coil winding. It is, therefore, necessary to integrate the voltage in order to acquire information of the electric current.

The remote controller comprises a remote user interface and a second transceiver circuit. The remote controller is configured to send the PSK band-pass signals to the first transceiver circuit in response to a plurality of signals generated from the remote user interface. The second transceiver circuit comprises a second transceiver and an encoder and controller. The encoder and controller is coupled between the remote user interface and the second transceiver and configured to convert the plurality of signals into a plurality of sets of binary data characters. Each of the plurality of sets of binary data characters comprises command data.

The remote user interface comprises keyboards in a computer-based lighting control management system. The keyboards are configured to generate the plurality of signals. At least two of the plurality of signals are respectively configured to turn on and off the controllable DC voltage, subsequently turning on and off the external LED luminaire. At least two of the plurality of signals are respectively configured to dim up and to dim down the external LED luminaire. At least one of the plurality of signals is configured to request metering and responding. The remote controller further comprises a voltage regulator with an enable input. The voltage regulator configured to supply a voltage to operate the second transceiver in response to an enable signal from the encoder and controller.

The second transceiver comprises a mixer, a front-end transmitter/receiver, an antenna embedded on a PCB, and two or more inductors interconnected in series. The mixer is configured to modulate the plurality of sets of binary data characters onto a carrier wave with a carrier phase shifted by 180 degrees whenever a binary data character "0" is transmitted. It should be appreciated that PSK signaling outperforming amplitude-shift keying (ASK) and frequency-shift keying (FSK) can be found in Digital Communication Theory. Owing to simplicity and reduced error probability, the PSK signaling is widely used in wireless local area network (LAN) standard, IEEE 802.11 and IEEE 802.15 using two frequency bands: at 868-915 MHz with binary PSK (BPSK) and at 2.4 GHz with offset quadrature PSK (OQPSK). Various applications in such two frequency bands include ones adopting protocols of Zigbee and Bluetooth for lighting controls.

In this disclosure, the LED luminaire controller may be adopted to couple to various LED luminaires such as high-power UFO lighting fixtures over 100 watts, sport lighting fixtures over 200 watts, low-power panel lights under 50 watts, LED lamps under 20 watts, etc. with the remote controller to control such LED luminaires to work in controllable on-off and dimming up and down environments without wiring and rewiring.

BRIEF DESCRIPTION OF THE DRAWINGS

Non-limiting and non-exhaustive embodiments of the present disclosure are described with reference to the following figures, wherein like reference numerals refer to like parts throughout the various figures unless otherwise specified. Moreover, in the section of detailed description of the invention, any of a "first", a "second", a "third", and so forth does not necessarily represent a part that is mentioned in an ordinal manner, but a particular one.

DETAILED DESCRIPTION OF THE INVENTION

Figure 1:
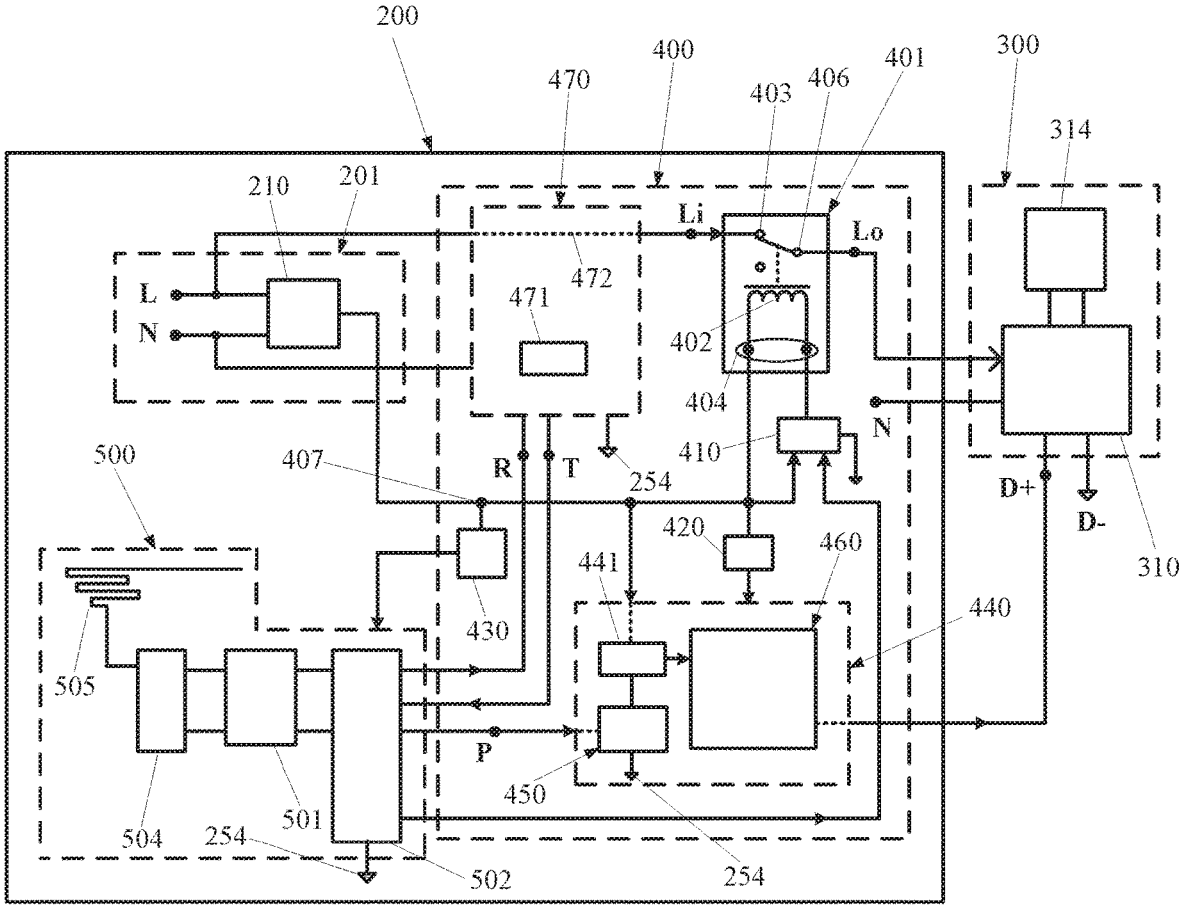
FIG. 1 is a block diagram of an LED luminaire controller according to the present disclosure.

FIG. 1 is a block diagram of an LED luminaire controller according to the present disclosure. In FIG. 1, an LED luminaire controller 200 is coupled to an external LED luminaire 300 comprising one or more LED arrays 314 (external one or more LED arrays 314, hereinafter) and a power supply unit 310 (external power supply unit 310, hereinafter) that may comprise a pair of dimming ports D+D−. The LED luminaire controller 200 comprises a power supply unit 201 comprising two electrical conductors "L" and "N" and a power converter circuit 210. The two electrical conductors "L" and "N" are configured to couple to the AC mains. The power converter circuit 210 is configured to couple to the two electrical conductors "L" and "N" to convert a line voltage from the AC mains into a first direct-current (DC) voltage appeared at a port 407. The LED luminaire controller 200 further comprises a control circuit 400 comprising a relay switch 401. The relay switch 401 comprises a coil 402 with a set voltage and is configured to couple the line voltage from the AC mains to the external power supply unit 310 to operate thereof when enabled, subsequently powering up the external one or more LED arrays 314 coupled with the external power supply unit 310. The external power supply unit 310 comprises an input operating voltage range such as 100-347 volts (AC or DC). The external power supply unit 310 comprises two electrical conductors "Lo" and "N". The pair of dimming ports D+D− are configured to receive a 0-to-10-V voltage for luminaire dimming applications. The external power supply unit 310 is a current source, providing various LED driving current to the external one or more LED arrays 314 to dim up or dim down thereof according to the 0-to-10-V voltage. The first DC voltage is a low DC voltage such as 5 V, which is less than 10 V. To convert the low DC voltage into the 0-to-10-V voltage, it is necessary to boost the low DC voltage to a higher operating voltage such as 12 V. For this purpose, the control circuit 400 further comprises a first voltage converter circuit 420 configured to up-convert the first DC voltage into a second DC voltage. Both the first DC voltage and the second DC voltage are with respect to a ground reference 254.

In FIG. 1, the LED luminaire controller 200 further comprises a first transceiver circuit 500 comprising a first transceiver 501 and a decoder and controller 502. The first transceiver circuit 500 is coupled to the control circuit 400 and configured to demodulate various phase-shift keying (PSK) band-pass signals and to output a pulse-width modulation (PWM) signal and a signal voltage via the decoder and controller 502 in response to the various PSK band-pass signals received by the first transceiver 501. The first transceiver 501 requires an operating voltage such as 3.3 V to operate. To convert the first DC voltage into the 3.3 V, it is necessary to down-convert the first DC voltage. For this purpose, the control circuit 400 further comprises a second voltage converter circuit 430 configured to down-convert the first DC voltage into a third DC voltage. Both the first DC voltage and the third DC voltage share the ground reference 254. The second voltage converter circuit 430 may be a type of a low-dropout (LDO) regulator featuring linearity to maintain a steady voltage, free of switching noises, simplicity, small size, high efficiency, etc.

The PWM signal is configured to control the external power supply unit 310 to provide the various LED driving current to dim up or dim down the external one or more LED arrays 314. However, the pair of dimming ports D+D− are configured to accept the 0-to-10-V voltage. For this purpose, the control circuit 400 further comprises a PWM-to-voltage converter 440 coupled to the first transceiver circuit 500 and configured to convert the PWM signal into the 0-to-10-V voltage in response to one of the various PSK band-pass signals. The PWM-to-voltage converter 440 comprises a first transistor 441, a low-pass filter circuit 460, and an optocoupler circuit 450 coupled between the first transceiver circuit 500 and the first transistor 441. The optocoupler circuit 450 is configured to buffer the PWM signal in a way that the low-pass filter circuit 460 powered by the second DC voltage can be operated without affecting an operation of the first transceiver circuit 500 powered by the third DC voltage. The first transistor 441 is configured to receive the first DC voltage and to convert the first DC voltage into a modulated voltage according to the PWM signal. The low-pass filter circuit 460 is configured to convert the modulated voltage into the 0-to-10-V voltage to operate a dimming circuit in the external power supply unit 310 without affecting stability of the low-pass filter circuit 460.

In FIG. 1, the first transceiver circuit 500 further comprises an antenna 505 embedded on a printed circuit board (PCB) and a radio-frequency (RF) front-end transmitter/receiver 504 configured to provide a single-ended matched impedance between an input to the RF front-end transmitter/receiver 504 and an output from the first transceiver 501 for maximum transmit/receive efficiency. In other words, this important process is designed to ensure signals to transmit without signal reflections and with a required transmission power. The decoder and controller 502 comprises a microcontroller, a microchip, or a programmable logic controller.

In FIG. 1, the relay switch 401 further comprises an AC input electrical terminal 403, an output electrical terminal 406, and a pair of DC electrical terminals 404, in which the AC input electrical terminal 403 is configured to couple to a hot wire (i.e., "Li") of the line voltage from the AC mains. The output electrical terminal 406 is configured to relay the hot wire of the line voltage to the external LED luminaire 300 from "Li" to "Lo". The pair of DC electrical terminals 404 are coupled to the coil 402 with one of the pair of DC electrical terminals coupled to the first DC voltage and the other one of the pair of DC electrical terminals coupled to a controllable DC voltage compatible to the first DC voltage. The control circuit 400 further comprises a second transistor 410 coupled to the first DC voltage and controlled by the signal voltage that the first transceiver circuit 500 outputs. The second transistor 410 is configured to generate the controllable DC voltage. When the signal voltage is absent, the controllable DC voltage disables the coil 402 and relays the hot wire of the line voltage to the external LED luminaire 300 to operate thereof. On the other hand, when the signal voltage is present, the second transistor 410 is on, and the controllable DC voltage is pulled down. The coil 402 thus receives the set voltage to operate, which disconnects the hot wire of the line voltage from coupling to the external LED luminaire 300.

In FIG. 1, the control circuit 400 further comprises a metering circuit 470 coupled to the relay switch 401 and configured to measure an operating voltage and an electric current flowing into the external LED luminaire 300. The metering circuit 470 comprises a metering device 471 that collects data of the operating voltage and the electric current and calculates power consumption of the external LED luminaire 300. The metering device 471 serially transfers the data out to the first transceiver circuit 500 via a port "T" when requested via a port "R". The metering circuit 470 further comprises a primary wire 472 connected between "L" and "Li", configured to couple the line voltage to the relay switch 401, furthering down to the external LED luminaire 300 when the relay switch 401 is set to relay the line voltage from "Li" to "Lo". The primary wire 472 is configured to measure the electric current flowing through the primary wire and to the external LED luminaire 300.

Figure 2:
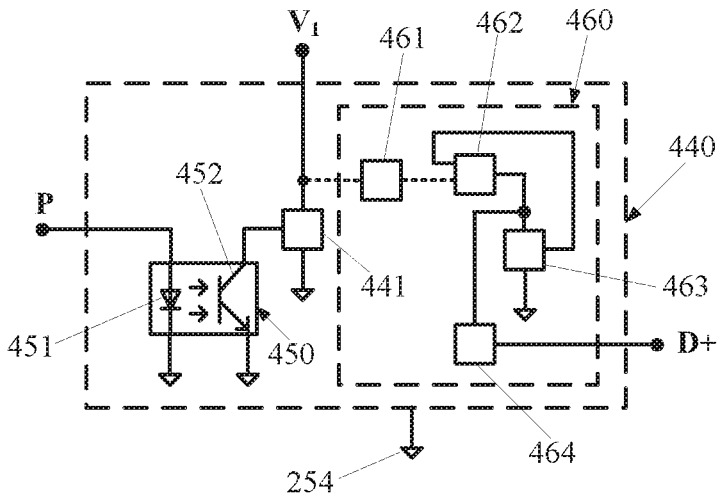
FIG. 2 is a block diagram of a PWM-to-voltage converter according to the present disclosure.

FIG. 2 is a block diagram of a PWM-to-voltage converter according to the present disclosure. The PWM-to-voltage converter 440 is coupled to the first transceiver circuit 500 via a port "P" and configured to convert the PWM signal into the 0-to-10-V voltage in response to one of the various PSK band-pass signals. The PWM-to-voltage converter 440 further comprises a first transistor 441, a low-pass filter circuit 460, and an optocoupler circuit 450 coupled between the transceiver circuit 500 and the first transistor 441. The optocoupler circuit 450 comprises an LED 451 and a phototransistor 452. The LED 451 is configured to emit a light signal responsive to the PWM signal whereas the phototransistor 452 is configured to receive the light signal and to interface the PWM signal with the first DC voltage (Vi) via the first transistor 441. In other words, the optocoupler circuit 450 is configured to buffer the PWM signal in a way that the low-pass filter circuit 460 powered by the second DC voltage can be operated without affecting an operation of the first transceiver circuit 500 powered by the third DC voltage. The first transistor 441 is coupled to the phototransistor 452 and configured to receive the first DC voltage and to convert the first DC voltage into a modulated voltage according to the PWM signal.

The low-pass filter circuit 460 comprises a voltage follower 464, an operational amplifier 462, and at least one stage of a resistor and a capacitor (RC) filter 461 coupled to the operational amplifier 462 as an input. The low-pass filter circuit 460 is configured to convert the modulated voltage into the 0-to-10-V voltage whereas the voltage follower 464 is configured to serve as a buffer to output the 0-to-10-V voltage to the external LED luminaire 300 to operate a dimming circuit in the external power supply unit 310 without affecting stability of the low-pass filter circuit 460. The low-pass filter circuit 460 further comprises a voltage divider 463 with two resistors (not shown) connected in series. A signal feedback from the voltage divider 463 to the other input of the operational amplifier 462 to set up a maximum voltage of 10 V for the 0-to-10-V voltage.

Figure 3:
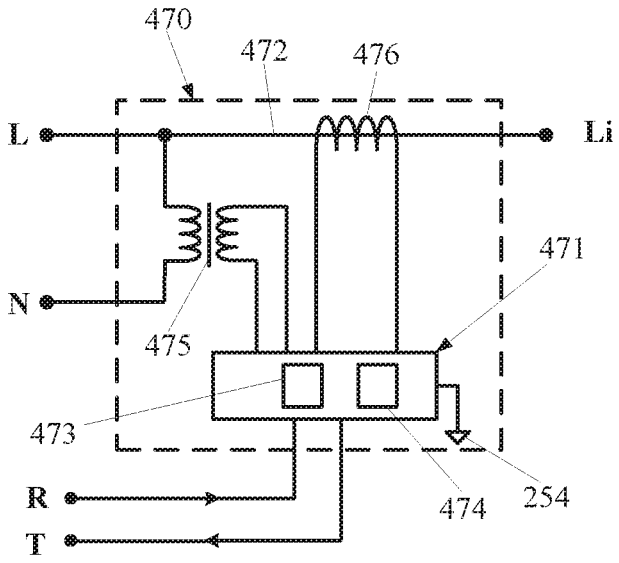
FIG. 3 is a block diagram of a metering circuit according to the present disclosure.

FIG. 3 is a block diagram of a metering circuit according to the present disclosure. In FIG. 3, the metering circuit 470 comprises the metering device 471 that collects data of the operating voltage and the electric current and calculates power consumption of the external LED luminaire 300. The metering device 471 comprises a data register 473 and an input/output interface 474. The data register 473 is configured to store data of the operating voltage, the electric current, and a calculated power consumption of the external LED luminaire 300. The input/output interface 474 serially transfers the data out via the port "T" to the first transceiver circuit 500 when requested via the port "R". The metering circuit 470 further comprises a voltage transformer 475 and an AC current transducer 476 respectively configured to measure the operating voltage and the electric current flowing into the external LED luminaire 300. The voltage transformer 475 comprises a turns ratio of 1000:1000 configured to isolate an input from a measuring output and to provide an acceptable linearity for an accurate voltage measurement. The AC current transducer 476 comprises a coil winding wound around the primary wire 472 connected between "L" and "Li". The electric current flowing through the primary wire 472 induces a voltage that is proportional to the rate of change of the electric current enclosed by the coil winding. It is, therefore, necessary to integrate the voltage in order to acquire information of the electric current.

Figure 4:
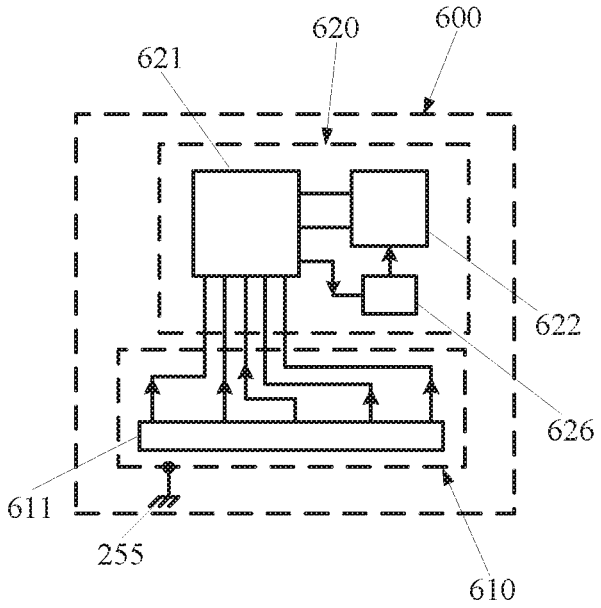
FIG. 4 is a block diagram of a remote controller according to the present disclosure.

FIG. 4 is a block diagram of a remote controller according to the present disclosure The remote controller 600 comprises a remote user interface 610 and a second transceiver circuit 620. The remote controller 600 is configured to send the PSK band-pass signals to the first transceiver circuit 500 in response to a plurality of signals generated from the remote user interface 610. The second transceiver circuit 620 comprises a second transceiver 622 and an encoder and controller 621. The encoder and controller 621 is coupled between the remote user interface 610 and the second transceiver 622 and configured to convert the plurality of signals into a plurality of sets of binary data characters. Each of the plurality of sets of binary data characters comprises command data.

The remote user interface 610 comprises keyboards 611 in a computer-based lighting control management system. The keyboards 611 are configured to generate the plurality of signals. At least two of the plurality of signals are respectively configured to turn on and off the controllable DC voltage, subsequently turning on and off the external LED luminaire 300. At least two of the plurality of signals are respectively configured to dim up and to dim down the external LED luminaire 300. At least one of the plurality of signals is configured to request metering and responding. The remote controller 600 further comprises a voltage regulator 626 with an enable input. The voltage regulator 626 is configured to supply a voltage to operate the second transceiver 622 in response to an enable signal from the encoder and controller 621.

Figure 5:
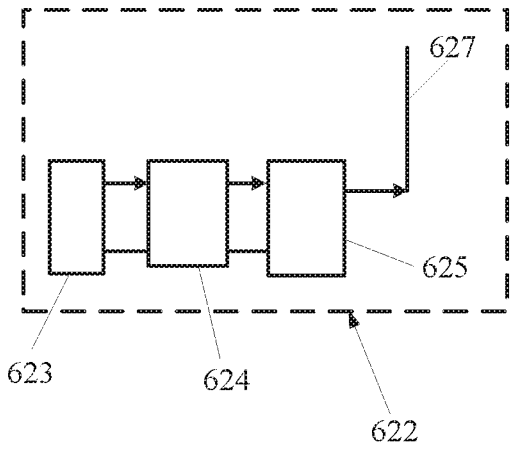
FIG. 5 is a block diagram of a second transceiver according to the present disclosure.

FIG. 5 is a block diagram of a second transceiver according to the present disclosure. The second transceiver 622 comprises a mixer 623, a front-end transmitter/receiver 624, an antenna 627 embedded on a PCB, and two or more inductors 625 interconnected in series. The mixer 623 is configured to modulate the plurality of sets of binary data characters onto a carrier wave with a carrier phase shifted by 180 degrees whenever a binary data character "0" is transmitted. It should be appreciated that PSK signaling outperforming amplitude-shift keying (ASK) and frequency-shift keying (FSK) can be found in Digital Communication Theory. Owing to simplicity and reduced error probability, the PSK signaling is widely used in wireless local area network (LAN) standard, IEEE 802.11 and IEEE 802.15 using two frequency bands: at 868-915 MHz with binary PSK (BPSK) and at 2.4 GHz with offset quadrature PSK (OQPSK).

Whereas preferred embodiments of the present disclosure have been shown and described, it will be realized that alterations, modifications, and improvements may be made thereto without departing from the scope of the following claims. Another kind of schemes with an LED luminaire controller that incorporates remote commands and controls for power switching, metering, and luminaire dimming or various kinds of combinations adopted to operate an LED luminaire to accomplish the same or different objectives could be easily adapted for use from the present disclosure. Accordingly, the foregoing descriptions and attached drawings are by way of example only and are not intended to be limiting.

What is claimed is:

1. A light-emitting diode (LED) luminaire controller, comprising:

a power converter circuit configured to couple to alternate-current (AC) mains and convert a line voltage from the AC mains into a first direct-current (DC) voltage;

a control circuit comprising a first voltage converter circuit, a relay switch, and an optocoupler circuit configured to receive a pulse-width modulation (PWM) signal and to control luminous intensity of an external LED luminaire; and a first transceiver circuit comprising a first transceiver and a decoder and controller, the first transceiver circuit coupled to the control circuit and configured to receive and demodulate various phase-shift keying (PSK) band-pass signals and to output the PWM signal and a signal voltage, wherein:

the first voltage converter circuit is configured to up-convert the first DC voltage into a second DC voltage;

the relay switch comprises a coil controlled by the signal voltage to turn on and off the line voltage from the AC mains with respect to the external LED luminaire; and the optocoupler circuit comprises an LED and a photo-transistor, the LED configured to emit a light signal responsive to the PWM signal, and the photo-transistor configured to receive the light signal and to interface the PWM signal with the first DC voltage.

2. The light-emitting diode (LED) luminaire controller of claim 1, wherein the control circuit further comprises a first transistor and a low-pass filter circuit operated by the second DC voltage, and wherein the first transistor is coupled to the photo-transistor and configured to receive the first DC voltage and to convert the first DC voltage into a modulated voltage according to the PWM signal.

3. The light-emitting diode (LED) luminaire controller of claim 2, wherein the low-pass filter circuit comprises a voltage follower, an operational amplifier, and at least one stage of a resistor-capacitor (RC) filter coupled to the operational amplifier as an input, wherein the low-pass filter circuit is configured to convert the modulated voltage into a 0-to-10-volt (V) voltage, and wherein the voltage follower is configured to serve as a buffer to output the 0-to-10-V voltage to the external LED luminaire without affecting stability of the low-pass filter circuit.

4. The light-emitting diode (LED) luminaire controller of claim 1, wherein the control circuit further comprises a metering circuit coupled to the relay switch and configured to measure an operating voltage and an electric current flowing into the external LED luminaire, and wherein the metering circuit comprises a metering device that collects data of the operating voltage and the electric current and calculates power consumption of the external LED luminaire.

5. The light-emitting diode (LED) luminaire controller of claim 4, wherein the metering device comprises a data register and an input/output interface, wherein the data register is configured to store data of the operating voltage, the electric current, and a calculated power consumption of the external LED luminaire, and wherein the input/output interface serially transfers the data out to the first transceiver circuit when requested.

6. The light-emitting diode (LED) luminaire controller of claim 5, wherein the metering circuit further comprises a voltage transformer and an AC current transducer respectively configured to measure the operating voltage and the electric current flowing into the external LED luminaire.

7. The light-emitting diode (LED) luminaire controller of claim 1, wherein the relay switch further comprises an AC input electrical terminal, an output electrical terminal, and a pair of DC electrical terminals, wherein the AC input electrical terminal is configured to couple to a hot wire of the line voltage from the AC mains, wherein the output electrical terminal is configured to relay the hot wire of the line voltage to the external LED luminaire, and wherein the pair of DC electrical terminals are coupled to the coil with one of the pair of DC electrical terminals coupled to the first DC voltage and the other one of the pair of DC electrical terminals coupled to a controllable DC voltage compatible to the first DC voltage.

8. The light-emitting diode (LED) luminaire controller of claim 7, wherein the control circuit further comprises a second transistor coupled to the first DC voltage and controlled by the signal voltage, wherein the second transistor is configured to generate the controllable DC voltage, and wherein, when the signal voltage is absent, the controllable DC voltage disables the coil and relays the hot wire of the line voltage to the external LED luminaire to operate thereof.

9. The light-emitting diode (LED) luminaire controller of claim 1, wherein the control circuit further comprises a second voltage converter circuit coupled to the first DC voltage and configured to regulate the first DC voltage into a third DC voltage to operate the first transceiver circuit.

10. The light-emitting diode (LED) luminaire controller of claim 1, wherein the decoder and controller comprises a microcontroller, a microchip, or a programmable logic controller.

11. The light-emitting diode (LED) luminaire controller of claim 1, further comprising:

a remote controller comprising a remote user interface and a second transceiver circuit, the remote controller configured to send the PSK band-pass signals to the first transceiver circuit in response to a plurality of signals from the remote user interface, wherein the second transceiver circuit comprises a second transceiver and an encoder and controller coupled between the remote user interface and the second transceiver and configured to convert the plurality of signals into a plurality of sets of binary data characters, and wherein each of the plurality of sets of binary data characters comprises command data.

12. The light-emitting diode (LED) luminaire controller of claim 11, wherein the remote user interface comprises keyboards in a computer-based lighting control management system, the keyboards configured to generate the plurality of signals.

13. The light-emitting diode (LED) luminaire controller of claim 11, wherein at least two of the plurality of signals are respectively configured to turn on and off the controllable DC voltage, subsequently turning on and off the external LED luminaire.

14. The light-emitting diode (LED) luminaire controller of claim 11, wherein at least two of the plurality of signals are respectively configured to dim up and to dim down the external LED luminaire.

15. The light-emitting diode (LED) luminaire controller of claim 11, wherein at least one of the plurality of signals is configured to request metering and responding.

* * * * *